United States Patent [19]

Comberg et al.

[11] Patent Number: 4,678,961

[45] Date of Patent: Jul. 7, 1987

[54] PROJECTION TELEVISION DISPLAY TUBE WITH IMPROVED COOLING

[75] Inventors: Albert A. Comberg; Johann Schröder, both of Aachen, Fed. Rep. of Germany

[73] Assignee: U.S. Philips Corporation, New York, N.Y.

[21] Appl. No.: 796,350

[22] Filed: Nov. 7, 1985

[30] Foreign Application Priority Data

Mar. 20, 1985 [DE] Fed. Rep. of Germany ..... 3510021

[51] Int. Cl.[4] ..... H01J 29/86; H01J 7/28

[52] U.S. Cl. ..... 313/36; 313/44; 313/477 R; 165/902

[58] Field of Search ..... 313/36, 44, 477 R; 165/902

[56] References Cited

U.S. PATENT DOCUMENTS 4,529,905 7/1985 Ohkoshi et al. ..... 313/44 X

FOREIGN PATENT DOCUMENTS 0020430 2/1985 Japan ..... 313/36

84/03390 8/1984 PCT Int'l Appl. ..... 313/477 R

*Primary Examiner*—Palmer C. DeMeo

*Attorney, Agent, or Firm*—F. Brice Faller

[57] ABSTRACT

Projection television display tube comprising an evacuated envelope having a display window provided on its inside with a display screen, a transparent second window which is disposed in front of said display window on its outside, and a transparent coolant flowing through the space between the display window and the second window, said coolant conveying the heat taken up at the display window through a cooling member to the atmosphere. The coolant is also in thermally conducting contact with a latent heat accumulator, so that an effective cooling is obtained even at peak loads of more than 40 W, and without external pipes.

13 Claims, 3 Drawing Figures

PROJECTION TELEVISION DISPLAY TUBE WITH IMPROVED COOLING

BACKGROUND OF THE INVENTION

The invention relates to a projection television display tube comprising an evacuated envelope having a display window provided on its inside with a display screen and a transparent second window which is disposed in front of the outside of the display window. Transparent coolant flows through the space between the display window and the second window, said coolant conveying the heat taken up at the display window through a cooling member to the atmosphere.

A display tube of this type is disclosed in DE-OS 30 21 431, to which U.S. Pat. No. 4,529,905 corresponds. A field is written with the aid of an electron beam on a display screen having a phosphor coating or a pattern of different phosphors. Due to the electron bombardment, the temperature of the phosphor increases so that the light output of the display screen decreases ("thermal quenching"). This phenomenon occurs particularly in display tubes for projection television in which the display screen is scanned by electron beams having high beam currents to obtain the required high luminous fluxes. The temperature of the display window increases and brings about a temperature gradient which causes a mechanical stress in the display window. At a high electron beam current and consequently a high thermal load this may lead to breakage of the display window. To reduce this mechanical stress in the display window due to variations in temperature ("thermal stress") and to obviate the decrease in light output the display window and the display screen are cooled. In a first described embodiment the coolant-filled space between the display window and the second window is surrounded on the upper, lower and lateral sides with a metal cooling member serving as a spacer and operating as a heat radiator. Due to the increase in temperature of the display window the coolant heated by the display window moves upwards along the display window and downwards along the second window so that the heat is also dissipated from the centre of the display window through the cooling member. At a low load, for example, less than 5 W, the heat is mainly dissipated by conduction to the second window. At a higher load the above-described flow of coolant occurs with little additional cooling.

Cathode ray tubes of up to approximately 40 W beam current capacity can be operated continuously with such a closed cooling system. A serious drawback of the known picture tube is, however, that there are no measures for operating the tube for a specific period at a value exceeding the permitted load of approximately 40 W. In fact, the thermal dynamic range of the known picture tube is essentially only defined by the available heat capacities of the coolant, cooling member and tube member. The result is a rapid temperature increase of the coolant and the display window exceeding the permitted temperature.

U.S. Pat. No. 4,529,905 also describes an embodiment in which the coolant is subjected to a cooling outside the space. To this end the coolant is circulated from the top of the space through pipe or tubing through a cooling chamber to the bottom of the space as a result of temperature differences in the coolant. With such an open cooling system it is possible to conduct up to 100 W and more beam current capacity away from the display window, but these open systems are technically very cumbersome since they require an external coolant circulation and a heat exchange separated from the display tubes. Due to the high manufacturing costs the open systems are not suitable for colour television projection apparatus in the domestic range. A further drawback of such a tube is that to replace the tube in a projector, the coolant must be removed and the tubing or pipe must be detached from the display tube.

SUMMARY OF THE INVENTION

It is an object of the invention to provide a display tube having an efficient cooling system for effective cooling at peak loads of more than 40 W and to provide a display tube having a cooling system without additional pipes and separate heat exchangers.

To realise these objects, the coolant is also in thermally conducting contact with a latent heat accumulator.

Latent heat accumulators utilize the latent heat of chemical compounds (for example, mirabilite, sodium thiosulphate or lithium fluoride) which heat is given off when these compounds crystallize, or is taken up when they melt (Enzyklopädie Naturwissenschaft und Technik, Vol. 3 (Münich 1980) page 2525). Such chemical compounds are designated hereinafter as latent heat accumulator agents. For cooling electrical systems or parts of systems whose operation is affected by heat evolution, a latent heat accumulator agent of this kind is in contact with such a system or system part. As a result of its thermal capacity and its transition from the solid to the liquid state the latent heat accumulator agent absorbs the heat to be dissipated from the system or system part and conveys this heat by conduction and convection to the atmosphere of the system or the system part (DE-AS 10 54 473, DE-PS 20 03 393, AT-PS 310 811). The heat evolving system part may be separated from the latent heat accumulator and the heat may be transferred between the separated parts by means of a liquid such as water moving in closed circulation as disclosed in U.S. Pat. No. 4,057,101.

According to the invention the latent heat accumulator is used in the cooling system of cathode ray tubes to handle peak loads. The basic principle is to compensate for these peak loads at the phase transition by means of conversion enthalpy of the latent heat accumulator agent. Regeneration of the latent heat accumulator is then effected when operating the cathode ray tube at a low load or in the switched-off state.

Due to their favourable thermodynamic properties salt hydrates and hydroxide hydrates are preferred as latent heat accumulator agents. In many cases it is efficient to add a nucleating agent to these latent heat accumulator agents so as to prevent undercooling.

Particularly suitable latent heat accumulator agents are calcium chloride hexahydrate, sodium acetate trihydrate and sodium hydroxide monohydrate. The latter latent heat accumulator agent has the additional advantage that it does not require a nucleating agent.

DETAILED DESCRIPTION OF THE INVENTION

Figure 1:
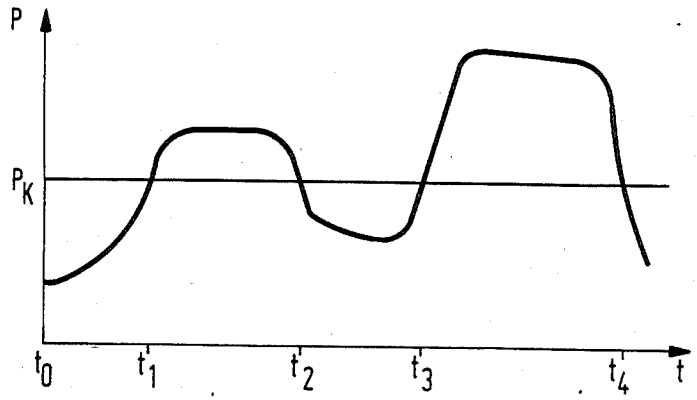
FIG. 1 is a graphic representation of the thermal capacity of a cathode ray tube to be dissipated as a function of the operating time.
Figure 2:
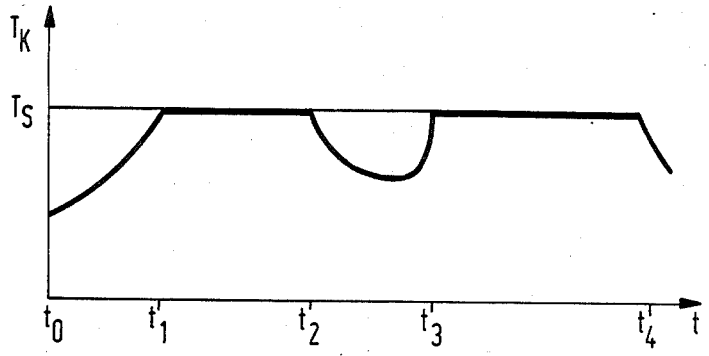
FIG. 2 is a graphic representation of the temperature of the coolant as a function of the operating time.

The operation of the latent heat accumulator is clarified in FIGS. 1 and 2. In FIG. 1 the thermal capacity P of the cathode ray tube to be dissipated is shown as a function of the operating time t. $P_K$ is the critical thermal capacity at which in known cooling system the temperature of the display window exceeds the permitted value. Cathode ray tubes which are conventionally cooled can operate safely only in the intervals $t_0$ to $t_1$ and $t_2$ to $t_3$. FIG. 2 shows how the temperature of the coolant and hence the temperature of the display window behaves in a cathode ray tube cooled in accordance with the invention. When the melting point $T_S$ of the latent heat accumulator agent is reached the heat developed in the coolant is used to melt the latent heat accumulator agent. From a thermo-dynamic point of view the attainment of $T_S$ involves a sudden increase of the thermal capacity of the entire cooling system. Consequently the further temperature increase is strongly damped independently of thermal transition coefficients between cooling member and air. The capacity of the latent heat accumulator is effectively chosen to have such a high value that the extra capacity being developed by $T_K$ in the interval $t_2$ to $t_1$ can be absorbed.

The principle of the cathode ray tube cooling having a latent heat accumulator will now be further described with reference to some embodiments.

EXAMPLE 1

Figure 3:
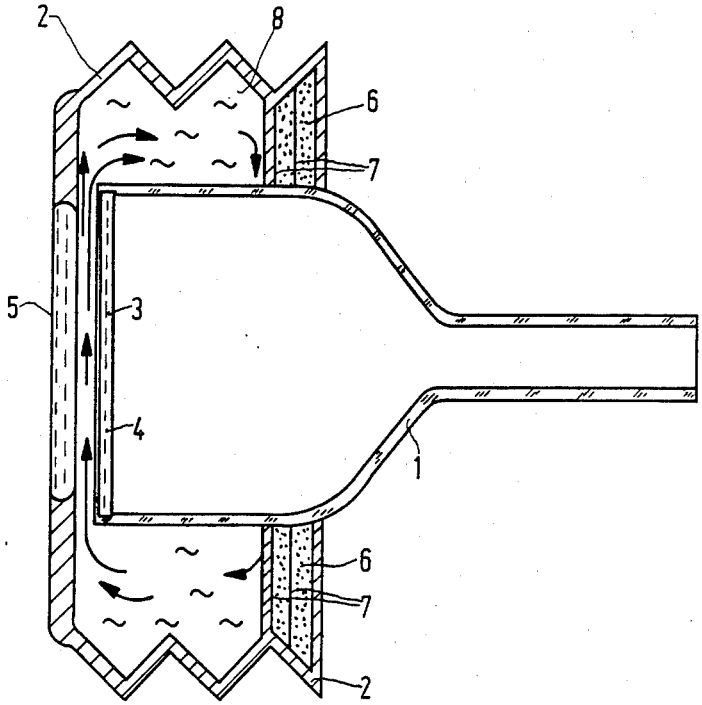
FIG. 3 is a sectional side view of a cathode ray tube including a cooling system.

The arrangement of an evacuated envelope of a cathode ray tube 1 and a cooling member 2 shown in a schematic diagram in FIG. 3 is used. The tube is sealed by means of a display window 3 having a display screen 4 disposed on its inside. A transparent second window 5 is provided essentially parallel to the outside of the display window 3. 600 grams of the latent heat accumulator agent 6, in this case calcium chloride hexahydrate $CaCl_2.6H_2O$ to which a nucleating agent was added according to DE-PS 27 31 572, DE-OS 32 40 855 and are embedded in ribs of the cooling member 2. FIG. 3 is a sectional view of the relevant part of the cooling member; the ribs fix the cooling member to the evacuated envelope. The cooling member 2 and its ribs consist of 0.5 mm thick high-grade steel but they may alternatively consist of synthetic material or aluminium coated with synthetic material. Connections 7 of the same material give stability to the construction and serve as thermal bridges in the latent heat accumulator agent 6. Water whose circulation is shown by arrows serves as a coolant 8, through other coolants may be chosen. The realisation of circulation of the coolant has been proposed in European Patent Application Nos. 84 200 784.1 and 84 200 785.8. The so-called heat pipe principle may also be utilized for heat transfer from the display window to the cooling member.

In the above described embodiment the cathode ray tube is disposed for a continuous load of 30 W. For such a continuous operation a coolant temperature of approximately 30° C. (dependent on the surface of the cooling ribs) is to be taken into account. The latent heat accumulator agent $CaCl_2.6H_2O$ was selected because its melting point is at $T_S=29.6°$ C. When the cathode ray tube is operated at a capacity $P>30$ W, the temperature increase of the coolant is discontinued at $T_S$ and the additional energy is utilized to melt the $CaCl_2.6H_2O$.

Since the melting enthalpy of $CaCl_2.6H_2O$ is $\Delta H_f=188$ kJ/kg, the cooling system can absorb an overload of $113\times10^3$ Wsec. In other words, an overload of the tube of 33% of the base load can even be compensated in case of an overload period of more than 3 hours.

EXAMPLE 2

The construction corresponds to that of embodiment 1. However, sodium acetate trihydrate $CH_3COONa.3H_2O$ is used as a latent heat accumulator agent. According to DE-patent application P 34 11 399.1 a nucleating agent has been added. The technically relevant properties of sodium acetate trihydrate are $T_S=58°$ C.

$\Delta H_f=226$ kJ/kg$=289$ kJ/dm$^3$ $Cp_{solid}=2.79$ kJ/kgK $Cp_{liquid}=4.58$ kJ/kgK In this embodiment the maximum temperature of the display window of the cathode ray tube is at approximately 60° C. With reference to embodiment 1 a particular profit is that the specific heat Cp of the latent heat accumulator agent $CH_3COONa.3H_2O$ doubles upon melting.

EXAMPLES 3 AND 4

The construction corresponds to that of example 1. However, sodium hydroxide monohydrate is used as a latent heat accumulator agent, namely either in the form of the congruently melting composition $(NaOH.H_2O)_{con}$ of 68.5% by weight of NaOH and 31.5 and by weight of $H_2O$ or in the form of the eutectic composition $(NaOH.H_2O)_{eut}$ of 74.2% by weight of NaOH. The technically relevant properties of these latent heat accumulator agents are

| | $(NaOH.H_2O)_{con}$ | $(NaOH.H_2O)_{eut}$ |
|---|---|---|
| $T_S$ | 64.3° C. | 61.0° C. |
| $\Delta H_f$ | 227.6 kJ/kg = 378.0 kJ/dm$^3$ | 195.6 kJ/kg = 335.8 kJ/dm$^3$ |
| $Cp_{solid}$ | 1.99 kJ/kgK | 1.51 kJ/kgK |
| $Cp_{liquid}$ | 2.48 kJ/kgK | 4.58 kJ/kgK |

What is claimed is:

1. A projection television display tube comprising an evacuated envelope having a display window with a display screen disposed on its inside, a transparent second window disposed in front of the outside of said display window to define a space between the display window and the second window, a transparent coolant flowing through said space, a cooling member retaining said coolant in a closed cooling system about said evacuated envelope, said cooling member dissipating heat from the display window to the atmosphere, and a latent heat accumulator in said cooling member, whereby said coolant is in thermally conducting contact with said latent heat accumulator, said latent heat accumulator including a latent heat accumulator agent.

2. A display tube as claimed in claim 1, characterized in that the latent heat accumulator agent in the latent heat accumulator is a salt hydrate.

3. A display tube as claimed in claim 2, characterized in that the latent heat accumulator agent in the latent heat accumulator is calcium chloride hexahydrate.

4. A display tube as claimed in claim 2, characterized in that the latent heat accumulator agent in the latent heat accumulator is sodium acetate trihydrate.

5. A display tube as claimed in claim 1, characterized in that the latent heat accumulator agent in the latent heat accumulator is a hydroxide hydrate.

6. A display tube as claimed in claim 5, characterized in that the latent heat accumulator agent in the latent heat accumulator is sodium hydroxide monohydrate.

7. A display tube as claimed in claim 6, characterized in that the latent heat accumulator comprises sodium hydroxide monohydrate in the form of a composition of 86.5% by weight of NaOH and 31.5% by weight of $H_2O$ congruently melting at 65.3° C.

8. A display tube as claimed in claim 6, characterized in that the latent heat accumulator comprises sodium hydroxide monohydrate in the form of a eutectic composition comprising 74.2% by weight of NaOH melting at 61.0° C.

9. A display tube as claimed in claim 2, characterized in that the latent heat accumulator agent comprises a nucleating agent.

10. a display tube as claimed in claim 3, characterized in that the latent heat accumulator agent comprises a nucleating agent.

11. A display tube as claimed in claim 4, characterized in that the latent heat accumulator agent comprises a nucleating agent.

12. A display tube as claimed in claim 5, characterized in that the latent heat accumulator agent comprises a nucleating agent.

13. A projection display device as in claim 1 wherein said cooling member includes ribs which fix the cooling member to the envelope, the latent heat accumulator agent being embedded in the ribs.

* * * * *